United States Patent [19]

Pringle et al.

[11] Patent Number: 4,771,831

[45] Date of Patent: Sep. 20, 1988

[54] LIQUID LEVEL ACTUATED SLEEVE VALVE

[75] Inventors: Ronald E. Pringle, Houston; Arthur J. Morris, Magnolia, both of Tex.

[73] Assignee: Camco, Incorporated, Houston, Tex.

[21] Appl. No.: 106,466

[22] Filed: Oct. 6, 1987

[51] Int. Cl.[4] ..... E21B 34/08

[52] U.S. Cl. ..... 166/319; 166/321; 166/332; 251/175

[58] Field of Search ..... 166/316, 319, 321, 323, 166/332; 251/175, 189; 137/517, 853

[56] References Cited

U.S. PATENT DOCUMENTS

| | | | |
|---|---|---|---|
| 4,201,364 | 5/1980 | Taylor | 166/332 X |
| 4,429,747 | 2/1984 | Williamson, Jr. | 166/321 |
| 4,434,854 | 3/1984 | Vann et al. | 166/319 X |
| 4,588,030 | 5/1986 | Blizzard | 166/120 |
| 4,721,162 | 1/1988 | Pringle et al. | 168/319 |

*Primary Examiner*—Jerome Massie, IV
*Assistant Examiner*—Bruce M. Kisliuk
*Attorney, Agent, or Firm*—Fulbright & Jaworski

[57] ABSTRACT

A tubing retrievable, hydrostatically operated liquid sleeve valve to control and shut off well production to the well surface of a producing well. The sleeve valve includes a port for supplying production fluid through the well annulus for pumping. When the pump stops, the liquid level in the annulus rises and creates a hydrostatic head against a sleeve piston which is biased to the open position by a gas charge. When the liquid reaches a selected level, the valve will move to a closed position. When the pump is reactivated, the liquid level is lowered and the valve is moved to the open position. Low friction seals minimize friction and a dynamic seal is set after the valve is shifted to the closed position.

10 Claims, 3 Drawing Sheets

Fig. 1A
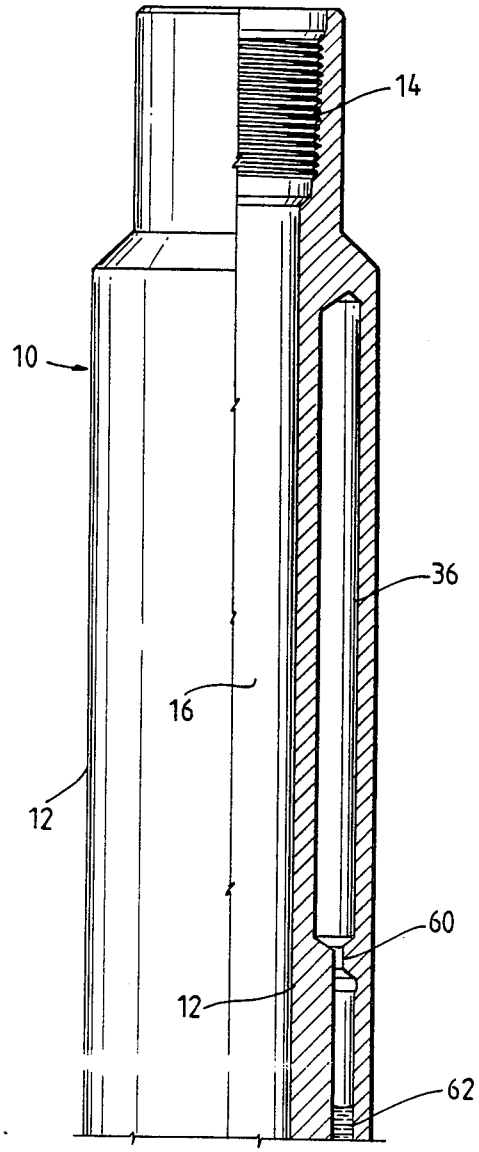
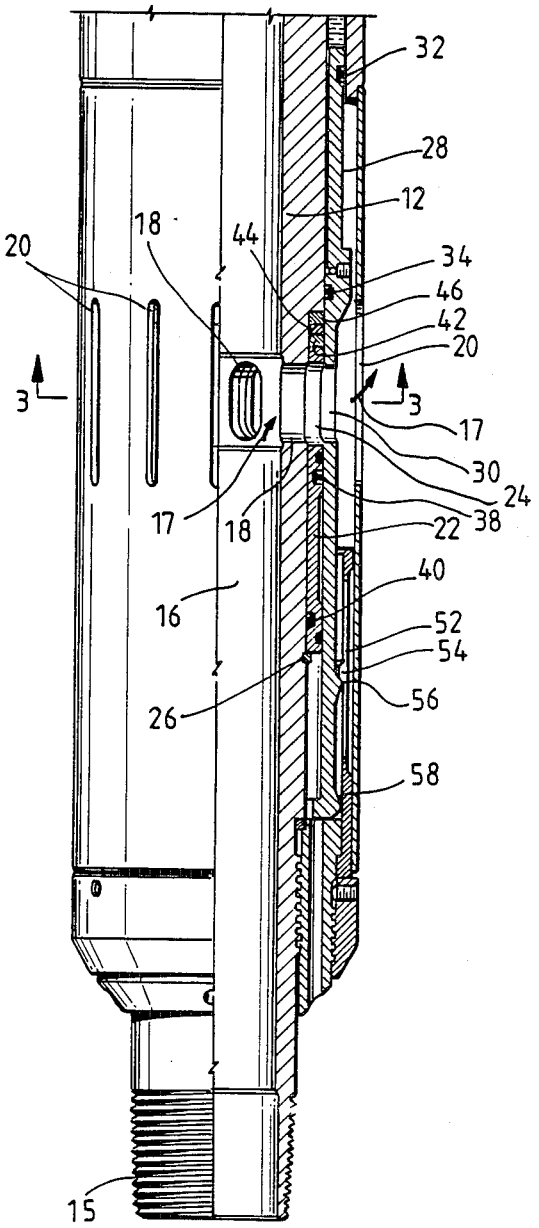
Fig. 1B

Fig. 2A
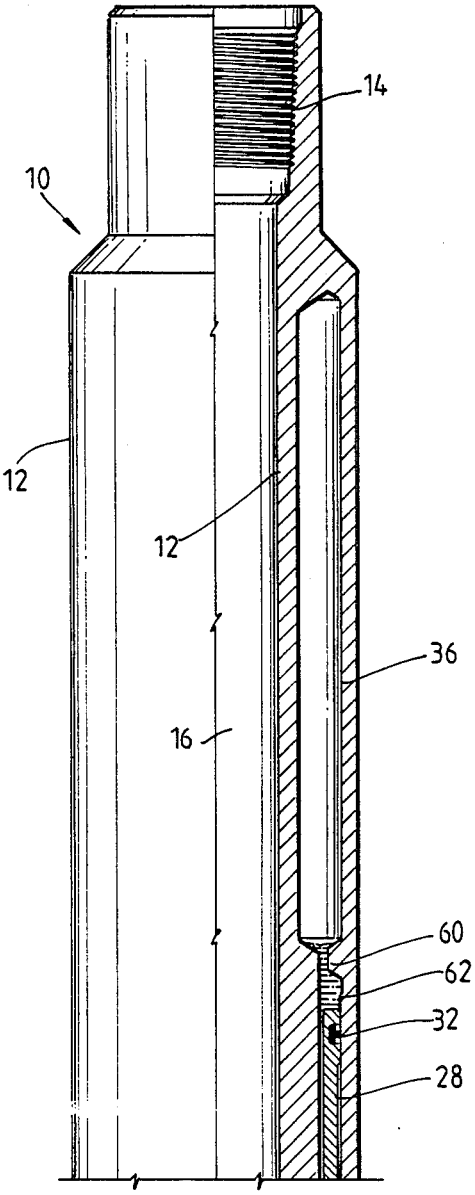
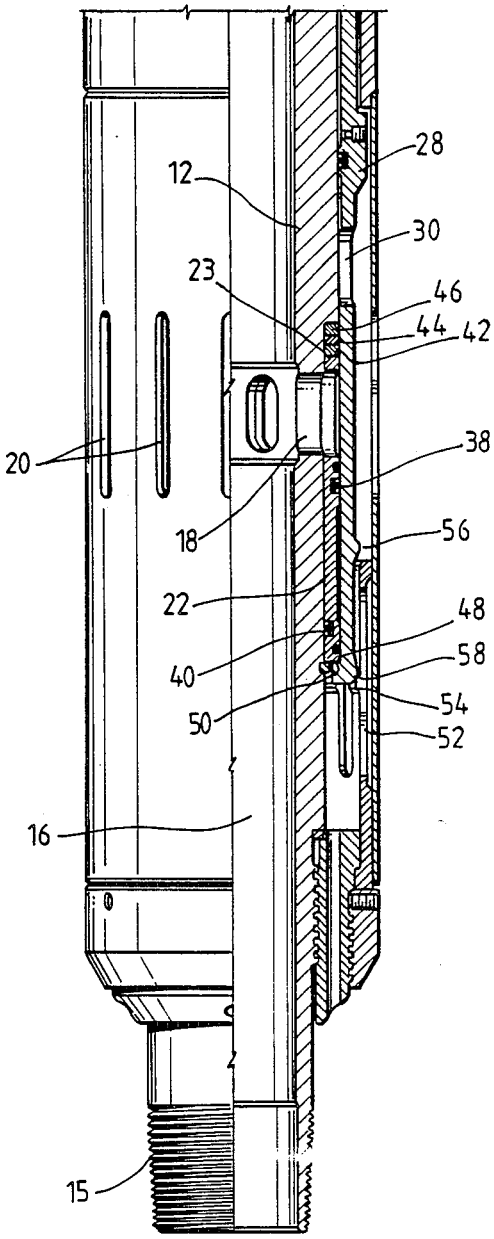
Fig. 2B

LIQUID LEVEL ACTUATED SLEEVE VALVE

BACKGROUND OF THE INVENTION

In a pumping fluid well, such as an oil well, the oil from the well formation flows into a well conduit and to the pump where it is then pumped to the well surface. However, it is sometimes desirable to shut off the flow of oil from the formation such as during workover operations. However, even with the pump turned off, the oil from the formation will continue to flow due to formation pressure and rise therein and interfere with workover operations.

It is known, as disclosed in U.S. patent application Ser. No. 06/645,574, filed 08/29/84, now U.S. Pat. No. 4,721,162, entitled "Fluid Level Controlled Safety Valve" to use the hydrostatic pressure created by the liquid level of the production liquids in a well conduit to shut off the flow of well production when the well pump is stopped. However, in such a system, the valve blocked the well conduit and had to be removed before wireline operations in the well could be performed below the location of the valve.

The present invention is directed to a liquid level actuated sleeve valve for use in a well tubing in a well casing in which the valve is actuated between open and closed positions by the hydrostatic pressure of the liquid level in the well annulus. Normally, the seals in sleeve valves have the disadvantages of (1) high friction, and (2) limited life caused by cycling of the sleeve over and damaging the seals. However, the present invention is directed to providing seals which have low friction and which are set and released to minimize seal damage.

SUMMARY

The present invention is directed to a tubing retrievable, hydrostatically actuated sleeve valve to control and shut off production to the well surface of a producing well in which the well is being pumped. When the pump ceases to function, the liquid level begins to rise in the well annulus due to natural formation pressure. This hydrostatic head acts on one side of a movable sleeve piston which is normally biased to an open position by a gas charge acting against the opposite side of the sleeve piston. When the liquid reaches a selected level, the hydrostatic head will move the sleeve valve to the closed position. When the pump is reactivated and the liquid level is lowered, the hydrostatic pressure is reduced and the gas charge will move the valve to the open position.

Still a further object of the present invention is the provision of a liquid level actuated sleeve valve for use in a well tubing in a well casing. The valve includes a body having connections at each end for connection in a well tubing and the body has a bore therethrough for allowing for wireline operations to be conducted through the body. The body also includes a first port in communication between the bore and the outside of the body for allowing the flow of well fluids from the bore to an annulus between the well tubing and the well casing for allowing pumping of well fluids to the well surface. A movable seal energizer sleeve telescopically engages the body and the seal sleeve has a second port generally aligned with the first port. A movable sleeve piston telescopically engages the energizer sleeve and includes a third port for opening and closing the first and second ports. The sleeve piston is exposed on a first side to fluid pressure outside of the body which acts in a direction to move the sleeve piston to a closed port position. A pressurized gas chamber in the body is in communication with the sleeve piston on a second side and acts in a direction to move the sleeve piston to an open port position. First seal means are provided between the sleeve seal and the sleeve piston and between the seal sleeve and the body. Second seal means are provided between the body and the sleeve piston and are engagable by the seal sleeve. Coacting shoulders on the sleeve piston and the seal sleeve are provided for moving the seal sleeve and compressing the second seal means when the sleeve piston moves to the closed position.

Yet a still further object of the present invention is the provision of a restriction in the body between the pressurized gas chamber and the sleeve piston and a liquid positioned between the restriction and the sleeve piston for dampening the sleeve piston near the end of the move of the piston to the closed port position.

Yet a still further object of the present invention is a provision of snap acting release means, such as spring collet means between the body and the sleeve piston for providing a fast snap action on opening and closing for minimizing seal damage.

Yet a still further object of the present invention is wherein the second seal means includes at least one flexible cup-shaped seal having lips which face the seal energizing sleeve whereby the second seal means may be expanded outwardly for sealing and retracting for protecting the seal.

Yet a still further object of the present invention is wherein the first seal means forms a second piston exposed to pressure in the bore for moving the seal energizer sleeve away from the second seal means prior to opening of the sleeve piston thereby allowing the second seal means to relax and retract before the third port moves across the seal.

Still a further object is the provision of a stop on the body limiting the movement of the seal sleeve away from the second seal means.

Other and further objects, features and advantages will be apparent from the following description of a presently preferred embodiment of the invention, given for the purpose of disclosure, and taken in conjunction with the accompanying drawings.

BRIEF DESCRIPTION OF THE DRAWINGS

FIGS. 1A and 1B are continuations of each other and form an elevational view, in quarter section, of the valve of the present invention shown in the open position, FIGS. 2A and 2B are continuations of each other and form an elevational view in quarter section of the valve of the present invention shown in the closed position.

BRIEF DESCRIPTION OF THE PREFERRED EMBODIMENT

Figure 3:
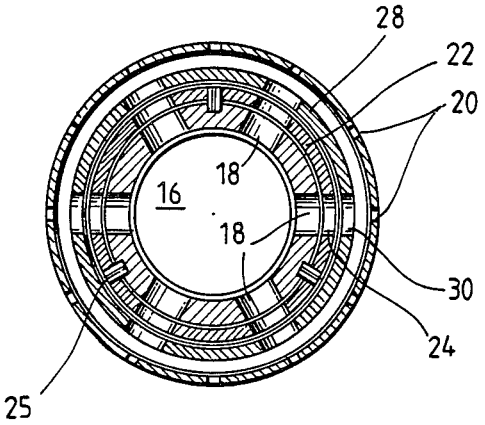
FIG. 3 is a cross-sectional view taken along the line 3—3 of FIG. 1B.

Referring now to the drawings, the reference numeral 10 generally indicates the liquid level actuated sleeve valve for the present invention having a body 12 with upper and lower connections such as threads 14 and 15, respectively. The threaded end connections 14 and 15 allow the body 12 to be connected in a conventional well tubing. The body 12 includes a bore 16 therethrough which is a full bore of the same size as the well tubing in which the body is connected. Therefore, wireline operations may be conducted in the well tubing and through the valve body 12.

The body 12 includes at least one port and preferably six ports 18 (FIG. 1B) in communication between the bore 16 and the outside of the body through slots 20. When the ports 18 are open, production from a producing well may flow upwardly in the well tubing and into the bore 16, out the ports 18 and into the annulus outside of the body 12 as indicated by arrows 17 and inside of a casing (not shown) where a pump, such as an electrical submersible pump, or other type of artificial lift, pumps the well production to the well surface. However, when the pump stops, the liquid level in the annulus continues to rise toward the surface by the natural formation pressure. In such an event, it is desirable to move the valve 10 to the closed position.

A movable seal energizer sleeve 20 telescopically engages the body 12. The sleeve 22 includes a second port 24 which remains generally aligned with the first port 18 by alignment pins 25. A stop 26 on the body 12 limits the downward movement of the seal sleeve 22.

A movable sleeve piston 28 telescopically engages the energizer seal sleeve 22 and the body 12. The sleeve piston 28 includes a third port 30 for opening and closing the first and second ports 18 and 24. The sleeve piston 28 includes piston seals 32 and 34 forming a piston engaging the body 12.

A pressurized gas chamber 36 (FIG. 1A), preferably containing nitrogen, is provided in the body 12 and is in communication with one side of the sleeve piston 28 and acts in a direction to bias and move the sleeve piston 28 to an open port position as best seen in FIG. 1B. Pressure outside of the body 12 in the well annulus acts on a second side of the sleeve piston 28 in a direction to move the sleeve piston 28 to a closed port position, as best seen in FIGS. 2A and 2B. First resilient seal means, as best seen in FIG. 1B, may include T-rings 38 and 40 sealing between the seal sleeve 22 and the sleeve piston 28, and between the seal sleeve 22 and the body 12, respectively. A second seal means is provided between the body 12 and the sleeve piston 28 and is engagable with the end of the seal sleeve 22. Preferably, the second seal means includes a first metal cup ring 42, a second plastic cup ring 44, such as sold under the trademark "Teflon" and a third metal cup ring 46.

Figure 4:
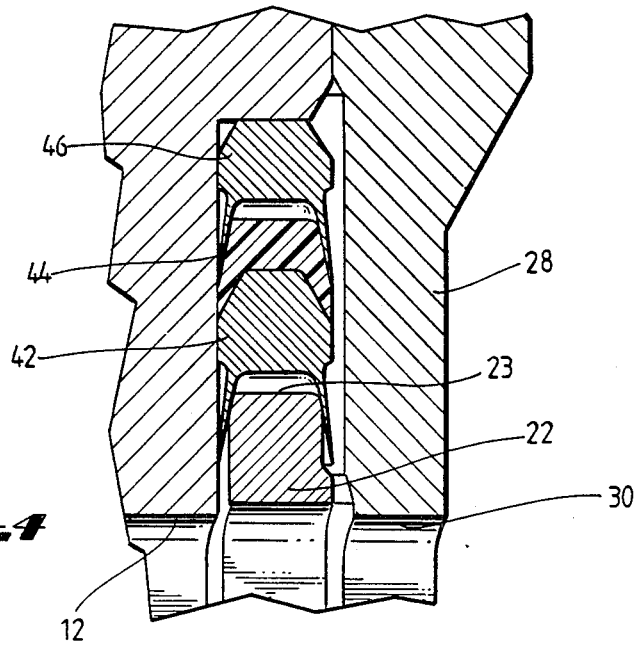
FIG. 4 is an enlarged fragmentary cross-sectional view of one form of second seal means shown in the relaxed position.

The problems with seals on sliding sleeve valves are that normally they create too much friction, and secondly they have a limited life as movement of the port 30 across the seals tends to wear and damage the seals. The T-seals 38 and 40 are not interference fit seals and therefore have minimum friction. In addition, they are not crossed by the port 30. They may be of plastic such as sold under the trademark VITON. The seals 42, 44 and 46 are not interference seals and are, as best seen in FIGS. 1B and 4, when the valve is in the open position, in an unset and retracted position. Therefore, when the sleeve piston 28 is actuated by a predetermined amount of fluid level in the annulus which creates a hydrostatic force overcoming the gas charge in the chamber 36, the port 30 will move over the seals 42, 44 and 46 without damage. Referring to FIG. 2B, when the sleeve piston 28 moves to the closed position as shown, it carries the third port past the seals 42, 44 and 46 without damaging the seals. As the sleeve piston 28 moves to the closed position, and reaches its extent of travel, coacting shoulder 48 on the sleeve piston 28 engages a shoulder 50 on the seal energizer sleeve 22 causing the upper end 23 (FIG. 4) of the seal energizer sleeve 22 to compress the seals 42, 44 and 46 into a sealing relationship between the body 12 and the sleeve piston 28. Setting is somewhat similar to that described in U.S. Pat. No. 4,588,030. The seal energizer sleeve 22 is moved away from stop 50 a short distance (not apparent from the drawing in FIG. 2B).

In the closed position it is noted that the first seal means consisting of the seals 38 and 40 acts as a piston exposed to the pressure of the well fluids in the bore 16. Therefore, when the well pump (not shown) is actuated to reduce the fluid level in the annulus and thus the hydrostatic pressure acting on the sleeve piston 28, the sleeve piston will start to open. However, prior to moving the port 30 over the seals 42, 44 and 46, the shoulder 48 will move away from the shoulder 50, and the internal pressure in the bore 16 will act on the seal sleeve 22 to retract it from the seals 42, 44 and 46 and thereby allow them to retract, as best seen in FIG. 4, prior to being engaged by the port 30.

However, operating the sleeve piston 28 with the hydrostatic force of fluid in the annulus would normally cause the sleeve 28 to slowly creep from the open position to the closed position as the fluid level rises in the annulus. This is undesirable as the seals 42, 44 and 46 would be exposed to the stream of flow of well fluids as the hydrostatic force gradually overcomes the pressure in the pressurized chamber 36. Therefore, it is preferable that the sleeve piston 28 move with a fast snap action on both closing and opening. Therefore, collet spring fingers 52 are provided in the body 12 about the sleeve piston 28 to provide a snap acting release means by means of a collet shoulder 54. The sleeve piston 28 includes a snap acting opening shoulder 56 and a snap acting closing shoulder 58. Thus, even though the hydrostatic head builds up and acts on the piston sleeve 28 the sleeve 28 will not move until the force is sufficient to overcome the spring action of the collet fingers 52 to allow the shoulder 56 to bypass the collet spring shoulder 54 and close the valve with a snap action. And, as best seen in FIG. 2B, the sleeve 28 will not move from the closed position to the open position until the hydrostatic force has decreased sufficiently so that the pressurized gas in the chamber 36 can move the shoulder 58 on the sleeve 58 downwardly past the shoulder 52 on the collet spring fngers 52 thereby opening the valve with a snap action.

Referring now to FIGS. 1A and 1B, a restriction 60 is provided in the body 12 between the pressurized gas chamber 36 and the sleeve piston 28 and a liquid 62, such as silicone fluid, is placed between the restriction 60 and the piston sleeve 28. As best seen in FIGS. 2A and 2B, as the piston cylinder 28 moves to the closed position with a snap action, it will quickly move the port 30 past the seals 42, 44 and 46 as any gas will quickly flow through the restriction 60. However, when the liquid 62 encounters the restriction 60, the piston sleeve 28 will be dampened. Therefore, while the seal energizer sleeve 22 will be moved against, engaged, and compress the seals 42, 44 and 46 into a set position, by the action of the sleeve piston 28, the dampening effect of the liquid 62 will slow down the movement of the piston sleeve 28 at its end of travel and prevent jarring of the seals 42, 44 and 46.

In operation, the slide valve 10 of the present invention is installed in a well tubing in a casing in a producing well and well fluid will flow through the well tubing, through the bore 16 of the valve 10, out the ports 18, 22 and 30, when the valve is in the open position, and flow into the annulus of the well. So long as a well pump keeps the fluid level in the annulus below a predetermined amount, the pressurized gas in the chamber 36 will act against the piston sleeve 28 to keep the valve 10 in the port open position. In the event that the pump stops, and the fluid level in the annulus rises to a predetermined level, a hydrostatic force acts on the piston sleeve 28 to overcome the force of the shoulder 54 on the collet fingers 52 and the sleeve piston 28 will move to the closed position carrying the seal energizer seal 22 to set the flexible seals 42, 44, and 46. In the event the pump is started to decrease the fluid level in the annulus, the hydrostatic force holding the sleeve piston in the closed position decreases, and the pressurized gas in the chamber 36 acts against the piston sleeve to move it toward the open position. When the opening force is sufficient so that the shoulder 58 can move by the collet spring shoulder 54, the sleeve piston 28 moves towards the open position and the pressure in the bore 16 acts against the seal energizer sleeve 22 for moving the sleeve 22 away from the seals 42, 44 and 46 and allow them to retract prior to the movement of the port 30 past the seals.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A liquid level actuated sleeve valve for use in a well tubing in a well casing comprising, a body having connections at each end for connection in a well tubing, said body having a bore therethrough, said body having a first port in communication between the bore and the outside of the body, a movable seal energizer sleeve telescopically engaging the body, said sleeve having a second port generally aligned with the first port, a movable sleeve piston telescopically engaging the seal energizer sleeve, said piston including a third port for opening and closing the first and second ports, said sleeve piston being exposed on a first side to fluid pressure outside of the body acting in a direction to move the sleeve piston to a closed port position, a pressurized gas chamber in the body in communication with the sleeve piston on a second side and acting in a direction to move the sleeve piston to an open port position, first seal means between the seal energizer sleeve and the sleeve piston, and between the seal energizer sleeve and the body, second seal means between the body and the sleeve piston and engagable by the seal energizer sleeve, and coacting shoulders on the sleeve piston and the seal energizer sleeve for moving the seal energizer sleeve and compressing the second seal means when the sleeve piston moves to the close position.

2. The apparatus of claim 1 including, a restriction in the body between the pressurized gas chamber and the sleeve piston, and a liquid between the restriction and the sleeve piston for dampening the sleeve piston near the end of the move of the sleeve piston to the closed port position.

3. The apparatus of claim 1 including, snap acting release means between the body and the sleeve piston normally holding the sleeve piston in the open port position but allowing the sleeve piston to rapidly move to the closed port position upon a sufficient pressure on the outside of the body acting on the sleeve piston to overcome the release means.

4. The apparatus of claim 1 including, snap acting release means between the body and the sleeve piston normally holding the sleeve piston in the closed port position but allowing the sleeve piston to rapidly move to the open position upon a sufficient lowering of the pressure on the outside of the body to allow the pressurized gas chamber to overcome the release means.

5. The apparatus of claim 3 wherein the snap acting release means is a spring collet.

6. The apparatus of claim 4 wherein the snap acting release means is a spring collet.

7. The apparatus of claim 1 wherein the second seal means includes at least one flexible cup-shaped seal having lips which face the seal energizer sleeve.

8. The apparatus of claim 1 wherein the first seal means forms a second piston exposed to pressure in the bore for moving the seal energizer sleeve away from the second seal means prior to the opening of the third port.

9. The apparatus of claim 8 wherein the first seal means includes a T-seal.

10. The apparatus of claim 1 including, a stop on the body limiting the movement of the seal sleeve away from the second seal means.

* * * * *